United States Patent [19]

Kisler

[11] 4,383,752

[45] May 17, 1983

[54] CONTINUOUS-DUTY BRUSH POLARIZER

[75] Inventor: Semyon Kisler, West Newton, Mass.

[73] Assignee: Polaroid Corporation, Cambridge, Mass.

[21] Appl. No.: 222,337

[22] Filed: Jan. 5, 1981

[51] Int. Cl.[3] ..... G03G 15/02

[52] U.S. Cl. ..... 355/3 CH; 361/225; 361/230; 361/235

[58] Field of Search ..... 355/3 R, 3 CH, 14 CH; 361/213, 229, 230, 235, 225

[56] References Cited

U.S. PATENT DOCUMENTS

| | | | |
|---|---|---|---|
| 2,774,921 | 12/1956 | Walkup | 355/3 CH X |
| 3,391,314 | 7/1968 | Carter | 361/235 X |
| 3,463,663 | 8/1969 | Choppa | 117/227 |
| 3,763,410 | 10/1973 | Phillips | 361/235 X |
| 3,801,894 | 4/1974 | Spiegel | 361/235 X |
| 4,158,071 | 6/1979 | Jordan et al. | 427/33 |
| 4,213,167 | 7/1980 | Cumming et al. | 361/213 |

OTHER PUBLICATIONS

Andrews et al.; "Controlling Polar Charge with Low Electrical Potentials"; Research Disclosure; Feb. 1980, p. 70.

*Primary Examiner*—Fred L. Braun
*Attorney, Agent, or Firm*—John J. Kelleher

[57] ABSTRACT

A decrease in the ability of an electrostatic charge controlling brush to place a uniformly distributed charge on charge-retaining material is precluded by limiting the amount of current available to the brush to less than the magnitude necessary to melt the free ends or tips of bristles forming a portion of the brush to thereby avoid changes in bristle tip shape and the attendant reduction in ability to produce a particular electrostatic charge level that would result from such bristle melting.

8 Claims, 6 Drawing Figures

CONTINUOUS-DUTY BRUSH POLARIZER

BACKGROUND OF THE INVENTION

1. Field of the Invention

The present invention relates to apparatus for establishing a relatively uniform charge level on charge-retaining materials, in general, and to such apparatus for establishing a uniform charge level on a moving web of such materials, in particular.

2. Description of the Prior Art

The presence of electrostatic charges on charge-retaining materials causes problems in many industries. In the photographic industry, for example, electrostatic charges on potential photographs or film units within a light-tight film cassette containing a plurality of film units for use in an "instant" type photographic camera, such as that sold by Polaroid Corporation, Cambridge, Mass., under its registered trademark SX-70, will often cling to one another with such intensity as a result of the force of attraction developed by such electrostatic charges, that proper ejection of an exposed film unit from said film cassette can be prevented if the effects of such charges are not controlled. In the SX-70 photographic film units mentioned above, for example, electrostatic charges are controlled by controlling the charge levels on components of said film prior to final film unit assembly.

In my copending U.S. patent application Ser. No. 183,326, filed Sept. 2, 1980, a brush-like device is employed to establish a desired electrostatic charge level on a moving web of charge-retaining material by passing said web through a relatively intense electrostatic field generated by said device when it is electrically connected to a relatively low potential DC source of suitable magnitude and polarity. A similar but more limited disclosure of said brush-like device is contained at page 70 in the February 1980 issue of Research Disclosure.

A shortcoming associated with electrostatic charge controlling conductive bristle brushes employed to establish an electrostatic charge on charge-retaining materials is their inability to continuously place a uniform charge on such materials for extended periods of time. When controlling electrostatic charges on, for example, a moving web of charge-retaining material with a conductive bristle brush of the type described above, streaks or strip-like portions of said web will fail to reach the same charge level as other web portions after several days of continuous web charging with such a conductive bristle brush.

SUMMARY OF THE INVENTION

In accordance with the teachings of the present invention, improved conductive bristle brush electrostatic charge-controlling apparatus is provided that is capable of producing a relatively uniform charge level on charge-retaining materials for extended periods of time. The apparatus includes an electrically conductive reference member, a brush having conductive bristles or filaments with one end of each of said bristles being connected to a common electrical conductor, a relatively low potential DC source connected between said common electrical conductor and said reference member, and means for limiting the current available to said conductive bristle brush from said potential source in order to prevent bristle tip deformation and the attendant loss of ability to produce a particular uniform charge level on charge-retaining materials with said brush as a result of changes in bristle tip shape resulting from excessive current generated heat that would otherwise occur without said current limiting means if the tips of said bristles should make contact with a low impedence, excessive current producing, conductive path.

DESCRIPTION OF THE PREFERRED EMBODIMENTS

In order to facilitate describing the preferred embodiments of the present invention, a brief description of electrostatic charge-controlling apparatus presently available in the prior art, over which the present invention is an improvement, will be provided.

Figure 1:
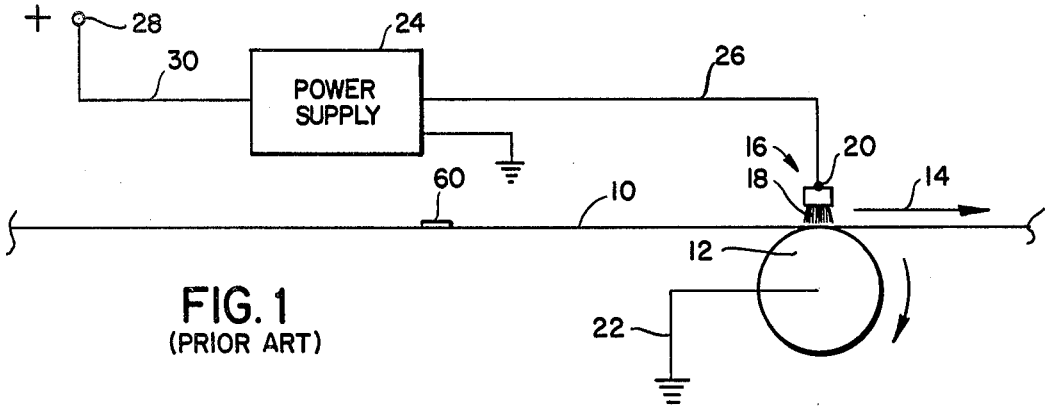
FIG. 1 (PRIOR ART)
FIG. 1 is an elevational view of a schematic diagram of conductive bristle brush type charge-controlling apparatus constructed in accordance with the prior art and a moving web of charge-retaining material having its charge controlled by said apparatus.

Turning to the drawings, in FIG. 1 a schematic diagram of charge-controlling apparatus for controlling the electrostatic charge on moving web of charge-retaining material 10 that is constructed in accordance with the prior art, is depicted. A roll of said material 10 is moved over electrically conductive, rotatably mounted cylindrical backing roller 12 in direction 14 at the desired rate of web 10 movement by suitable drive means (not shown) coupled to said web 10.

Brush 16 is mounted in a fixed position and in a spaced relation with respect to web 10 and backing roller 12. The construction of brush 16 will be described below in detail. For the present, however, it should be noted that brush 16 does include a multiplicity of conductive bristles or filaments 18 with an end of each of said filaments being electrically connected to common electrical conductor 20. Backing roller 12 is constructed of electrically conductive materials and said roller 12 is connected to ground potential through path 22. The output of power supply or DC potential source 24 is connected to common electrical conductor 20 through path 26. The input of power supply 24 is connected to a source of electrical energy at terminal 28 (not shown) through path 30. Power supply 24 and grounded backing roller 12 are connected to the same ground potential. When power supply 24 is energized, a relatively intense electrostatic field is established between the free ends of bristles 18 of brush 16 and grounded backing roller 12. The use of a multiplicity of conductive bristles or filaments in the form of brush 16 coupled to a suitable potential source results in an electrostatic field being established with an electrical potential whose magnitude is substantially less than that necessary for the generation of corona. The reason for being able to establish a relatively intense field with a relatively low voltage will be explained below in detail.

As web 10 is moved in direction 14 over roller 12 between the free ends of bristles 18 and grounded roller 12, through the relatively intense electrostatic field established between said free bristle ends and said roller 12, electrostatic charges retained by said web 10 are controlled or regulated by said electrostatic field. The magnitude and polarity of the potential supplied by potential source 24 is established before web 10 is so moved, by empirically determining the electrostatic field intensity necessary for the desired degree of web 10 electrostatic charge regulation. Alternatively, a power supply incorporating a feedback control system that senses the extent to which the electrostatic charge on web 10 has been regulated by brush 16 and then changes the output potential of said power supply in response to said sensed electrostatic charge in order to obtain the desired charge level on said web 10 may also be employed.

In the apparatus of FIG. 1, brush 16 is spaced a finite distance from moving web 10. By so spacing said brush from said moving web 10 the magnitude of the potential applied to said brush must be increased in order to obtain the same electrostatic field intensity over an arrangement where brush 16 was in actual contact with web 10. This is so because the brush to web spacing introduces an electrical impedence or resistance to the generation of an electrostatic field between these components. The electrostatic charge level on web 10 can be properly regulated at lower DC potential when brush 16 is in direct contact with said web 10. However, scratching of the surface of web 10 may occur and such scratching may render portions of web 10 useless for incorporation in an end product.

Brushes that are utilized to control the charge level on charge-retaining materials such as web 10 in FIG. 1 usually have a bristle or filament density in excess of 120 K filaments per square inch and preferably in excess of 150 K filaments per square inch. The number of square inches of brush filaments and the physical dimensions of a particular brush are determined by considering such factors as speed of web movement, the initial web charge level and the type of material of which the web is formed. If, as in the charge controlling arrangement of FIG. 1, a web such as web 10 is moved over roller 12 at a relatively high rate of speed, it may be necessary to employ two or more commonly connected brushes and space them about the circumference of said roller 12 if a single brush is insufficient to establish the desired web charge level.

Brush 16 in FIG. 1 includes a multiplicity of conductive bristles 16 that have their ends connected to common electrical conductor 20, as previously noted. Bristles 18 of said brush 16 are circular in cross section and are normally constructed of conductive materials such as conductive nylon or stainless steel. Practically any conductive material may be employed for use as bristle material so long as its electrical resistance is 500 megohms or less. Low resistances are not necessary because, unlike a corona-generated field, only a minute amount of current is utilized; primarily for leakage and for dipole orientation.

It is a well-known electrical phenomenon that more intense electrostatic fields can be generated at sharp angle or small radius of curvature surfaces for the same applied potential than at smooth or large radius of curvature surfaces. The most useful conductive bristle brushes have bristle diameters of 50 microns or less. With a bristle of this size the surface at the tip or free end of said bristle forms a surface with a radius that approaches zero. With such a small radius, a relatively intense electrostatic field can be generated at the tip of such a bristle with a potential that is well below the approximately 4.5 KV DC level where a corona would normally first appear and very often at a potential of 1.5 KV DC.

In the operation of the prior art apparatus of FIG. 1, web 10 is moved between the free ends of conductive bristle brush 16 and backing roller 12 in direction 14 by drive means (not shown) for the purpose of having its electrostatic charge level changed. As shown in more detail in FIG. 2A, web has its electrostatic charge level changed from +700 V to a desired uniform charge level of −200 V as it is so moved between energized conductive bristle brush 16 and grounded, electrically conductive backing roller 12. However, after an extended period of continuous web charging (usually 2–3 days), the charge level established by said brush 16 on said web 10 becomes nonuniform in a manner such as that depicted in FIG. 3A. Whereas in FIG. 2A the electrostatic charge level was changed from +700 V to a uniform −200 V, in FIG. 3A the +700 V charge level on web 10 is changed to stripes of −200 V and +300 V. The nonuniform charge level, in this particular example, consists of the difference between the desired −200 V charge level produced by brush 16 along the edges of web 10 in FIG. 3A and the undesired +300 V charge level stripe that is also produced by brush 16 at the center of web 10 in said FIG. 3A.

Figure 2A:
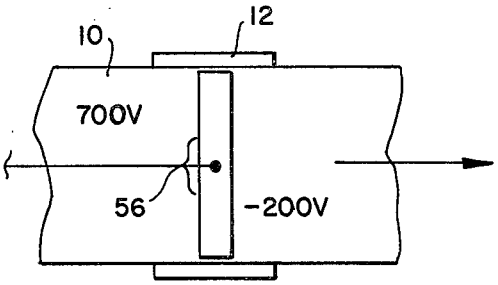
FIG. 2A is a top view of the conductive bristle brush, conductive reference member and a portion of the moving web of FIG. 1 having its electrostatic charge satisfactorily changed to a particular charge level.
Figure 3A:
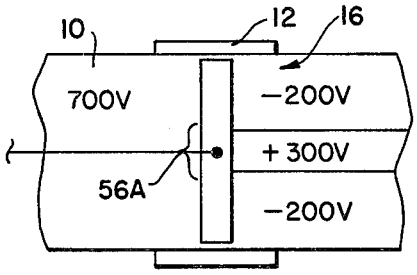
FIG. 3A is a top view of the conductive bristle brush, conductive reference member and a portion of the moving web of FIG. 1 having its electrostatic charge level unsatisfactorily changed to a nonuniform charge level after an extended period of charge-controlling time.

As discussed above with respect to FIGS, 1, 2A and 3A, the web charging apparatus of FIG. 1 will produce a uniform charge on a moving web of charge-retaining material for only a limited period of time. Whereas web 10 in FIG. 2A is being charged to the desired uniform charge level as it is moved between energized conductive bristle brush 16 and grounded backing roller 12, this uniformly is not present on said web 10, as shown in FIG. 3A, after said web is continuously moved between brush 16 and backing roller 12 for an extended period of time. After a considerable period of investigation I determined that the reason for the change in charge level uniformity was due to a change in the shape of the tips or free ends of bristles 18 of conductive bristle brush 16.

As stated above, a bristle having a diameter of 50 microns or less has a radius of curvature at its free end that approaches zero. Any increase in this radius would produce a correspondingly less intense electrostatic field, for the same electrical potential level, than would be produced if said zero radius of curvature were maintained.

Figure 2B:
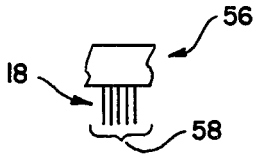
FIG. 2B is a fragmentary elevational view of a portion of the conductive bristle brush depicted in FIG. 2A.
Figure 3B:
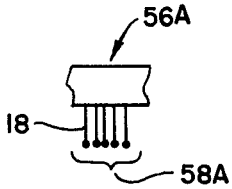
FIG. 3B is a fragmentary elevational view of a deteriorated portion of the conductive bristle brush in FIG. 1 after an extended period of electrostatic charge-controlling service.

The reason for the said change in bristle tip shape mentioned above is due to excessive current passing through one or more brush bristles. When electrically conductive materials such as web splicing tape, foreign matter or the like, pass between the free ends of an energized conductive bristle brush and its associated grounded backing roller, excessive electrical-current-produced heat in said bristles will melt, deform, and thereby increase the radius of curvature of the free ends of said bristles. This occurs because said electrically conductive tape or foreign matter, etc., provides an extremely low impedence path to ground for the power supply to which the conductive bristle brush is connected, causing excessive current to pass through one or more brush bristles. As shown in FIG. 2B, which is a fragmentary elevational view of center portion 56 of brush 16 in FIG. 2A, the free ends or tips 58 of bristle 18 of said brush 16 are of uniform cross section along their entire length including said tips 58. With such uniform cross section bristles a uniform electrostatic charge can be placed on, for example, moving web 10. However, after an extended period of continuous web charging the electrostatic charge placed on said web 10 by brush 16 is no longer uniform. As shown in FIG. 3B, which is a fragmentary elevational view of center portion 56A of conductive bristle brush 18 after an extended period of continuous web 10 electrostatic charging, the shape of the free ends or tips 58A of bristles 18 in said FIG. 3B have been changed by the excessive heat from current passing through said bristles 18 when they periodically touch low impedence electrically conductive structure such as electrically conductive tape 60 in FIG. 1, as said tape 60 moves between said bristles 18 and grounded backing roller 12. Other electrically conductive low impedence materials passing between brush 16 and roller 12 in FIG. 1 such as the foreign matter mentioned above may also cause the free ends or tips of bristles 18 to melt and thereby change their radii of curvature.

Figure 4:
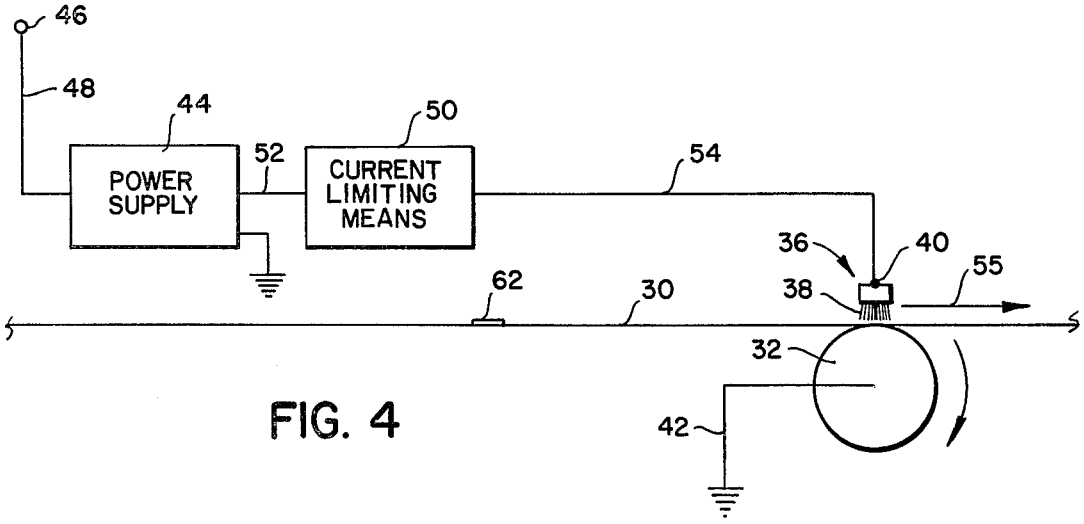
FIG. 4 is an elevational view of conductive bristle brush charge controlling apparatus as in FIG. 1 that additionally includes the bristle-current limiting improvement of the present invention.

Turning now to the present invention and to FIG. 4 where apparatus incorporating a preferred embodiment of said present invention is depicted. FIG. 4 is an elevational view of conductive bristle brush web charging apparatus that avoids the nonuniform charging problem shown in FIG. 3A produced by the web charging apparatus of FIG. 1.

In FIG. 4, brush 36 is mounted in a fixed position and in a spaced relation with respect to both web 30 and electrically conductive, rotatably mounted cylindrical backing roller 32. The construction of brush 36 is the same as that of brush 16 described above in FIG. 1. As discussed above, a brush such as brush 36 in FIG. 1 includes a multiplicity of conductive bristles on filaments 38 with an end of each of said filaments being electrically connected to common electrical conductor 40. Backing roller 32 is constructed of electrically conductive material and said roller 32 is connected to ground potential through path 42. The input of power supply 44 is connected to a source of electrical energy at terminal 46 (not shown) through path 48. Power supply 44 and grounded backing roller 32 are connected to the same ground potential. The output of power supply or DC potential source 44 is connected to current limiting means 50 through path 52 and the output of current limiting means 50 is connected to common electrical conductor 40 of conductive bristle brush 36 through path 54.

As web of charge-retaining material 30 is moved in direction 55 between conductive bristle brush 36 and grounded backing roller 32, at the desired rate of web 30 movement, by suitable drive means (not shown) coupled to said web 30, the electrostatic charge level on web 30 is changed to the desired charge level by the relatively intense electrostatic field established between energized conductive bristle brush 36 and electrically conductive backing roller 32. If electrically conductive structure such as web splicing tape 62 should provide a low electrical impedence path between a free end of one or more of bristles 18 and roller 32, excessive current through said bristles would be prevented by current limiting means 50 preferably in the form of a current limiting resistor. This potentially excessive current would be limited to a magnitude that is less than a magnitude that would excessively heat a single conductive bristle.

DISCUSSION

When it has been determined that an excessive current may or actually does flow in an electrical circuit it is fairly common practice to prevent such excessive current with current limiting means that can take on any number of different forms. The most difficult aspect of providing current limiting means is the determination as whether or not it is necessary to limit the current in a particular electrical circuit. Inasmuch as the preferred bristle diameter is in the neighborhood of 50 microns, a change in bristle tip shape resulting from excessive bristle current cannot be detected without the aid of optics capable of providing a considerable degree of bristle tip magnification. A power supply such as power supply 44 in FIG. 4 often incorporates output current limiting means. However, if the problem is not recognized as one that relates to excessive current caused by a low impedence load connected to the output of a power supply having current limiting means there would be no reason to activate the current limiting feature of said power supply. Even if a power supply had a current limiting feature that was activated all of the time, said current limiting feature would normally be well above that necessary to prevent current-related heat from melting tip 58A, for example, of extremely small diameter (50 microns) bristles 18 in FIG. 3B.

In the improved electrostatic charge regulating apparatus of the present invention described above and schematically illustrated in FIG. 4, current limiting means 50 limits the magnitude of the power supply 44 current available to a single bristle of conductive bristle brush 36. It is conceivable that a single conductive bristle might form a portion of the only low electrical impedence path to ground and the current produced in such a situation should be limited to below a magnitude capable of heating and deforming a single bristle tip. A less conservative and less protective technique would be to assume simultaneous multiple bristle low impedence contact and then limit power supply current to less than the attendant larger current magnitude.

In this preferred embodiment current limiting means 50 in FIG. 4 consist of a 100 megohm resistor whose function is to protect the 50 mil diameter conductive nylon bristles of brush 36. With power supply 44 having an electrical potential of 1500 V DC at its output, the current available to brush 36 in FIG. 4 will be limited to approximately 15 microamps. In corona-type electrostatic charge regulating apparatus it is essential to have substantial ion current moving between a high potential electrode and an electrically conductive reference member in order to produce the necessary electric field intensity for the desired degree of electrostatic charge control. In conductive bristle brush-type electrostatic charge control apparatus, however, only a minimal amount of current, such as a 15 microamp current mentioned above or less, is necessary for proper control of electrostatic charges on charge-retaining materials.

As noted above, current limiting means 50 in FIG. 4 is preferrably an electrical resistor. However, means for interrupting current from power supply 44 when it equals or exceeds a predetermined value such as a circuit breaker or the like may also be employed even though considerably less effective than a current limiting resistor.

The term electrostatic field employed herein means one species of electric field.

It will be apparent to those skilled in the art from the foregoing description of my invention that various improvements and modifications can be made in it without departing from its true scope. The embodiments as described herein are merely illustrative and should not be viewed as the only embodiments that might encompass my invention.

What is claimed is:

1. Improved apparatus for regulating electrostatic charges on charge-retaining materials, comprising:

a common electrical conductor;

means for establishing an electrically conductive reference surface;

a multiplicity of electrically conductive elongated bristles supported over said reference surface with one end of said bristle being in an electrically coupled relation to said common conductor, said bristles extending from their said one end toward said reference surface with the free ends of said bristles being adjacent said reference surface;

a DC power source connected between said common electrical conductor and said reference surface, the potential of said power source having a predetermined magnitude and polarity for establishing an electric field that will adjust the electrostatic charge to the desired charge level on charge-retaining material passed between said free bristle ends and said reference surface; and means for limiting the electrical current available to said bristles from said power supply to less than a magnitude that will cause a deformation of a free end of said bristles when the said free end comes in contact with conductive material electrically coupled to said reference surface.

2. The apparatus of claim 1, wherein the said current available to said bristles from said power is limited to less than a magnitude that will deform a single conductive bristle.

3. The apparatus of claim 1, wherein said current limiting means is an electrical resistor.

4. The apparatus of claim 1, wherein said current limiting means is a circuit interrupter.

5. The apparatus of claim 1, wherein the diameter of each of said conductive bristles is equal to or less than 50 microns.

6. The apparatus of claim 1, wherein said bristles are formed of conductive nylon.

7. The apparatus of claim 1, wherein said bristles are formed of stainless steel.

8. The apparatus of claim 1, wherein said electric field is an electrostatic field.

* * * * *